US006442868B1

(12) United States Patent
Wolf et al.

(10) Patent No.: US 6,442,868 B1
(45) Date of Patent: Sep. 3, 2002

(54) HEATED DRYING CYLINDER

(75) Inventors: Robert Wolf, Herbrechtingen; Markus Oechsle, Bartholomae; Wolfgang Mayer, Heidenheim; Thomas Mack, Sontheim; Roland Mayer, Heidenheim, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/621,653

(22) Filed: Jul. 21, 2000

(30) Foreign Application Priority Data

Jul. 24, 1999 (DE) ..... 199 34 868

(51) Int. Cl.[7] ..... F26B 3/00

(52) U.S. Cl. ..... 34/443; 34/580; 34/94; 34/110; 34/111; 34/115

(58) Field of Search ..... 34/580, 94, 443, 34/110, 111, 115, 116, 134, 138, 634; 432/228

(56) References Cited

U.S. PATENT DOCUMENTS

| | | | | |
|---|---|---|---|---|
| 4,324,613 A | * | 4/1982 | Wahren | 162/111 |
| 4,740,305 A | * | 4/1988 | Miller | 210/783 |
| 4,788,779 A | | 8/1988 | Sparkes | |
| 5,274,930 A | * | 1/1994 | Ensign et al. | 34/23 |
| 5,553,391 A | * | 9/1996 | Bakalar | 34/110 |
| 5,575,084 A | | 11/1996 | Vuorinen | |
| 5,784,801 A | * | 7/1998 | Throp et al. | 34/115 |
| 6,088,926 A | * | 7/2000 | Steiner et al. | 34/117 |
| 6,105,276 A | | 8/2000 | Ensign et al. | |
| 6,210,268 B1 | * | 4/2001 | Fleissner | 454/262 |

FOREIGN PATENT DOCUMENTS

| | | |
|---|---|---|
| DE | 1144987 | 3/1963 |
| DE | 1635343 | 4/1971 |
| DE | 1629124 | 12/1971 |
| DE | 2832840 | 2/1979 |
| EP | 0296730 | 12/1988 |
| EP | 0694648 | 1/1996 |
| WO | 98/58123 | 12/1998 |

* cited by examiner

*Primary Examiner*—William C. Doerrler
*Assistant Examiner*—Mark Shulman
(74) *Attorney, Agent, or Firm*—Greenblum & Bernstein, P.L.C.

(57) ABSTRACT

A drying cylinder for drying a fibrous web, the cylinder having an inner chamber connected to a pressurized air source; and an outer cylinder jacket having an air-permeable region which is adapted to contact the fibrous material web. Also a drying section for drying a fibrous web, including at least one drying cylinder having an inner chamber and an outer cylinder jacket having an air-permeable region; a circulating belt arranged to press the fibrous web against the outer cylinder jacket and belt being arranged to partially wrap around the drying cylinder; and a pressurized air source connected to the inner chamber is described. Finally, a process for drying a fibrous web in an apparatus that includes at least one drying cylinder having an inner chamber and an outer cylinder jacket having an air permeable region, the process including pressurizing the inner chamber of the drying cylinder with air; and guiding the fibrous material web partially around the drying cylinder with a circulating belt wherein the circulating belt presses the fibrous material web against the air permeable portion of the cylinder jacket is described.

37 Claims, 1 Drawing Sheet

HEATED DRYING CYLINDER

CROSS-REFERENCE TO RELATED APPLICATIONS

The present application claims priority under 35 U.S.C. §119 of German Patent Application No. 199 34 868.5, filed on Jul. 24, 1999, the disclosure of which is expressly incorporated by reference herein in its entirety.

BACKGROUND OF THE INVENTION

1. Field of the Invention

The present invention relates to a heated drying cylinder for drying a fibrous material web partially wrapped around it, in particular, a paper, cardboard, or tissue web, in machines for producing and/or refining the same, in which a continuously circulating belt presses the fibrous material web against the cylinder jacket of the drying cylinder.

2. Discussion of Background Information

Such drying cylinders have been known for a long time, with the drying cylinders being arranged in one or more rows and the fibrous material web usually being guided around them in a meandering fashion. In this connection, one or more drying wires are often used as a supporting belt.

The drying cylinders, which are generally heated by steam, have a smooth surface for the purpose of guaranteeing a high heat transfer to the fibrous material web. However, this smooth surface is also associated with relatively large adhesive forces in relation to the fibrous material web, which causes problems upon removal of the fibrous material web after it has wrapped around the cylinder.

After the removal of the drying wire, the fibrous material web continues to adhere to the drying cylinder for a distance, albeit a short one. Only when the web tension is great enough does the fibrous material web detach from the drying cylinder and continue to follow the drying wire.

This can cause the fibrous material web to rip or at least to stretch with the risk of forming creases. The problem is amplified as machine speed increases.

SUMMARY OF THE INVENTION

An aspect of the present invention is therefore to develop a heated drying cylinder which, besides efficient drying, also allows for easy removal of the fibrous material web.

This aspect is attained, according to the invention, in that the cylinder jacket is air-permeable in the region of contact with the fibrous material web and the inner chamber of the drying cylinder is connected to a pressurized air source. A pressurized air cushion is formed thereby between the cylinder jacket and the fibrous material web such that an equilibrium occurs between the pressure of the pressurized air streaming from the drying cylinder and the contact pressure of the belt as well as the web tension. As a result, the removal of the fibrous material web is in fact assisted so that the fibrous material web can immediately follow the belt without stretching of the fibrous material web occurring. Furthermore, the heat can be transferred from the drying cylinder to the fibrous material web by means of the pressurized air.

The region of contact is defined as the region of the cylinder jacket that comes into contact with the fibrous material web during rotation of the drying cylinder. In order to prevent the escape of pressurized air in the region of the drying cylinder not wrapped around by the fibrous material web, fixed coverings can be arranged inside or outside the cylinder jacket.

The cylinder jacket should preferably be perforated in the entire region of contact with the fibrous material web. In order to even out the pressurized air cushion, it is further advantageous for the cylinder jacket to be wrapped at least in the region of contact by an air-permeable cylinder belt that is as smooth as possible; the cylinder belt should be embodied as a woven belt, preferably with metallic content.

Furthermore, the belt should be embodied as a drying wire in a known manner. In order to improve drying, it is advantageous for the pressurized air preferably to be heated in the drying cylinder.

Due to the lack of a contact surface between the drying cylinder and the fibrous material web, it is further advantageous for the cylinder jacket of the drying cylinder to be heated to a temperature of over about 200° C., preferably in the range of about 200° to 400° C., which lies considerably above the generally common values. This can be accomplished with infrared radiators, gas burners, and/or induction heaters. This results in a greater drying output being achieved without damaging the fibrous material web as well as a stronger heating of the pressurized air on its way through the cylinder jacket. At these temperatures, water vapor is additionally guided from the fibrous material web to the pressurized air cushion, which has a positive effect on the drying performance.

In order to considerably facilitate a backside ventilation of the fibrous material web during removal but, on the other hand, also to guarantee a good heat transfer to the fibrous material web during the stable guidance thereof, the pressure of the pressurized air should be selected high enough that a pressurized air cushion forms between the cylinder jacket and the fibrous material web with a maximum thickness of about 2 mm, preferably between about 0.5 and 1 mm.

Because of the high efficiency, one or more drying cylinders should be used, in particular in the initial region of the drying section.

According to an aspect of the present, a drying cylinder for drying a fibrous web is presented, the cylinder including an inner chamber connected to a pressurized air source; and an outer cylinder jacket having an air-permeable region which is adapted to contact the fibrous material web.

According to another aspect of the present invention, the cylinder is used in machines for producing and refining at least one of paper, cardboard, and tissue web. In another aspect of the present invention, the circulating belt presses the fibrous web against said cylinder.

According to a further aspect of the present invention, the air-permeable region includes perforations. In another aspect of the present invention, a drying cylinder is presented having an air-permeable cylindrical belt, wherein the outer cylinder jacket is covered by the air-permeable cylinder belt, said the having a smooth surface arranged to contact the fibrous material web.

In another aspect of the present invention, the cylindrical belt is a woven belt. According to still a further aspect of the present invention, the circulating belt is a drying wire belt. Further aspects of the invention include providing pressurized air that is heated in the drying cylinder.

According to another aspect of the present invention, a drying cylinder is provided having a heating device arranged to heat said cylinder jacket to a temperature of over about 200° C., in particular, in a range of about 200° to 400° C.

According to a further aspect of the present invention the heating device includes at least one of infrared radiators, gas burners, and induction heaters. According to still a further aspect of the invention the pressurized air is controlled to a pressure level which produces a pressurized air cushion between the cylinder jacket and the fibrous material web.

According to an aspect of the present invention, the pressurized air cushion has a maximum thickness of about 2 mm, and preferably between about 0.5 mm and 1 mm.

According to another aspect of the present invention, the cylinder jacket is metal. In another aspect of the present invention, the perforations are bores. According to a further aspect of the present invention, the air-permeable region is substantially the same width as the fibrous material web.

In another aspect of the present invention, the inner chamber includes a fixed cover positioned proximate a portion of the cylindrical jacket is not in contact with the fibrous material web, wherein the fixed cover is adapted to prevent pressurized air from escaping from the portion of the jacket which is not in contact with the fibrous material web.

According to a further aspect of the present invention, a drying section for drying a fibrous web, is provided having at least one drying cylinder having an inner chamber and an outer cylinder jacket having an air-permeable region; a circulating belt arranged to press the fibrous web against the outer cylinder jacket and belt being arranged to partially wrap around the at least one drying cylinder; and a pressurized air source connected to the inner chamber.

In another aspect of the present invention, the pressurized air source is adapted to form an air cushion between the outer cylinder jacket and the fibrous web. According to still a further aspect of the present invention, the drying section includes at least one of infrared radiators, gas burners, and induction heaters for heating said drying cylinder.

According to still a further aspect of the present invention, the cylinder jacket has an air-permeable region which is in contact with the fibrous material web. Further aspects of the invention include a cylinder jacket has perforations in said air permeable region.

According to other aspects of the present invention, the cylinder jacket is covered by an air-permeable cylinder belt, the belt having a smooth surface in the region of contact with the fibrous material web. According to another aspect of the present invention, the cylinder belt is a woven belt.

According to a further aspect of the present invention, the circulating belt is a drying wire belt. According to an aspect of the present invention, the pressurized air source is heated in the drying cylinder. In another aspect of the present invention, the drying section includes a heater positioned to heat said cylinder jacket to a temperature of over about 200° C., preferably in a range of about 200° to 400° C.

In another aspect of the present invention, the pressurized air source is controlled to a pressure level which produces a pressurized air cushion between the cylinder jacket and the fibrous material web. According to still a further aspect of the present invention the pressurized air cushion has a maximum thickness of about 2 mm, preferably about 0.5 mm and 1 mm.

Further aspects of the invention include a cylinder jacket is metal. According to other aspects of the present invention the perforations are bores. According to another aspect of the present invention the air-permeable region is substantially the same width as the fibrous material web.

According to a still further aspect of the invention, the inner chamber includes a fixed cover positioned proximate a portion of the cylindrical jacket is not interface in contact with the fibrous material web, wherein the fixed cover is adapted to prevent pressurized air from escaping from the portion of the jacket which is not in contact with the fibrous material web.

According to an aspect of the present invention a process is provided for drying a fibrous web in an apparatus that includes at least one drying cylinder having an inner chamber and an outer cylinder jacket having an air permeable region, the process including: pressurizing the inner chamber of the at least one drying cylinder with air; and guiding the fibrous material web partially around the at least one drying cylinder with a circulating belt wherein the circulating belt presses the fibrous material web against the air permeable portion of the cylinder jacket.

In another aspect of the present invention, an air cushion is provided between said cylinder jacket and the fibrous material web. According to a further aspect of the present invention, the process further includes heating, through induction, the at least one drying cylinder with at least one of infrared radiators, gas burners, and induction heaters.

In another aspect of the present invention, the cylinder jacket has perforations in the air permeable region. According to still a further aspect of the present invention, the circulating belt includes an air-permeable cylinder belt, the belt having a smooth surface in the region of contact with the fibrous material web. Further aspects of the invention include a cylinder belt is a woven belt. According to other aspects of the present invention, the circulating belt is a drying wire belt.

According to another aspect of the present invention, the process further includes heating the pressurized air in said drying cylinder. According to a further aspect of the present invention, the cylinder jacket is heated to a temperature of over about 200° C.; preferably in a range of about 200° to 400° C.

According to an aspect of the present invention, the process includes controlling the pressurized air to a pressure level which produces a pressurized air cushion between said cylinder jacket and said fibrous material web. According to another aspect of the present invention, the pressurized air cushion has a maximum thickness of about 2 mm; preferably between about 0.5 mm and 1 mm.

In another aspect of the present invention, the cylinder jacket is metal. According to a further aspect of the invention, the perforations are bores. In another aspect of the present invention, the air-permeable region is substantially the same width as the fibrous material web.

According to a further aspect of the present, the inner chamber includes a fixed cover positioned proximate a portion of the cylindrical jacket is not in contact with the fibrous material web, wherein the fixed cover prevents pressurized air from escaping from the portion of the jacket which is not in contact with the fibrous material web.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

The invention will be explained in greater detail in the following based on an exemplary embodiment. The attached drawings show.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
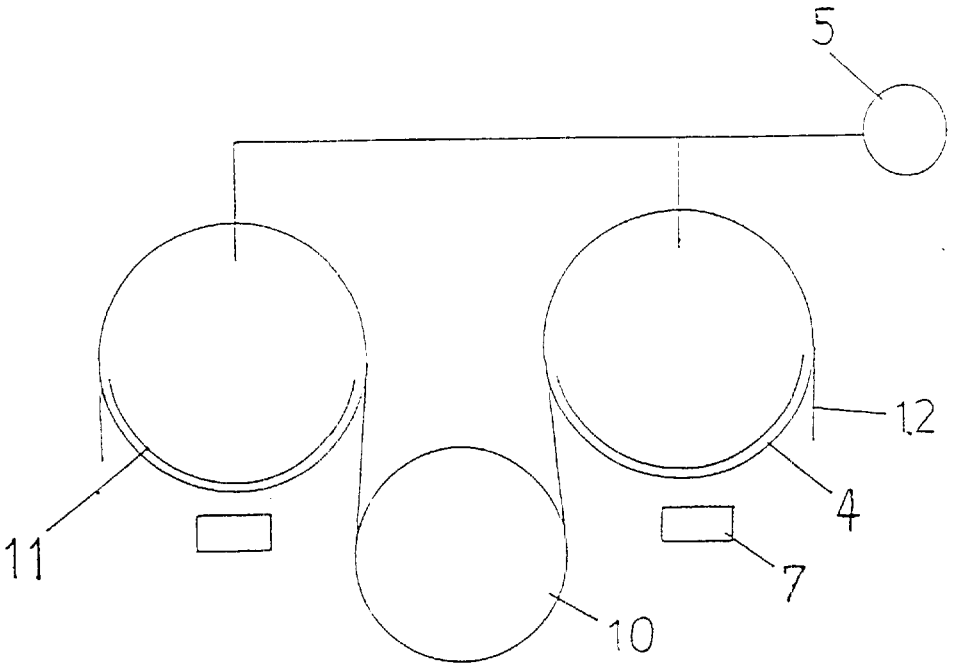
FIG. 1 is a schematic section of a drying group.

In the drying group shown in FIG. 1, the fibrous material web 1 is alternately guided over heated drying cylinders 4 and guide rolls 10 such that the belt 2 in the form of a drying wire guides the fibrous material web 1 and presses it against the drying cylinder 4. The cylinder jacket 3 of the drying cylinder 4 is embodied in an air-permeable manner and the inner chamber of the drying cylinder 4 is connected to a pressurized air source 5. In order to prevent pressurized air from escaping through the region of the cylinder jacket 3 that is not wrapped by the fibrous material web, fixed covers 11 are arranged in this region inside the drying cylinder 4.

The metal cylinder jacket 3 is heated by induction heaters 7 applied from outside that are arranged in the region of the drying cylinder 4 that is not wrapped by the fibrous material web. The goal in this context is temperatures of the cylinder jacket 3 of over about 200° C. At these high temperatures, the pressurized air is heated very quickly as it passes through, which improves the drying results. Here, the pressure of the pressurized air is so great that a pressurized air cushion 8 with a thickness of about 0.5 to 1 mm forms between the cylinder jacket 3 and the fibrous material web 1. This occurs as a function of the contact pressure of the belt 2 as well as the web tension of the fibrous material web 1 and sufficiently eases the removal of the fibrous material web 1 from the drying cylinder 4.

Figure 2:
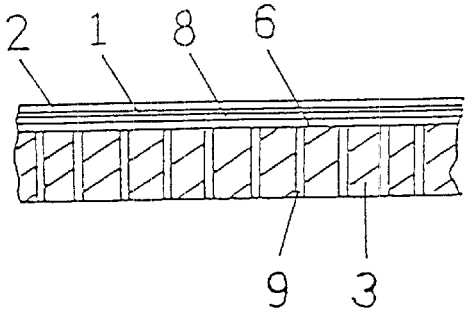
FIG. 2 is a partial section of a drying cylinder 4.

According to FIG. 2, the actual cylinder jacket 3 is perforated, i.e., provided with bores 9 in the region of contact with the fibrous material web 1. In order to even out the pressurized air cushion 8, the cylinder jacket 3 is wrapped in its region of contact by an air-permeable cylinder belt 6 in the form of a metal wire that is as smooth as possible. This metal wire is heated by the induction heater 7 in the same way as the cylinder jacket 3.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A drying cylinder for drying a fibrous web, said cylinder comprising:

an inner chamber connected to a pressurized air source;

an outer cylinder jacket having an air-permeable region which is adapted to contact the fibrous material web;

a cover located within the cylinder jacket to selectively define the air permeable region; and a radiant heating device positioned adjacent the cover to heat the outer jacket cylinder.

2. A drying cylinder according to claim 1, wherein said cylinder is used in machines for producing and refining at least one of paper, cardboard, and tissue web.

3. A drying cylinder according to claim 1, wherein a circulating belt presses the fibrous web against said cylinder.

4. A drying cylinder according to claim 1, wherein said air-permeable region comprises perforations.

5. A drying cylinder according to claim 1 in combination with an air-permeable cylindrical belt, wherein said outer cylinder jacket is covered by said air-permeable cylinder belt, said belt having a smooth surface arranged to contact the fibrous material web.

6. A drying cylinder according to claim 5, wherein said cylindrical belt is a woven belt.

7. A drying cylinder according to claim 3, wherein the circulating belt is a drying wire belt.

8. A drying cylinder according to claim 1, wherein the pressurized air is heated in said drying cylinder.

9. A drying cylinder according to claim 1, said radiant heating device arranged to heat said cylinder jacket to a temperature of over about 200° C.

10. A drying cylinder according to claim 9, wherein said heating device is arranged to heat said cylinder jacket to a temperature in a range of about 200° to 400° C.

11. A drying cylinder according to claim 9, wherein the radiant heating device comprises at least one of infrared radiators, gas burners, and induction heaters.

12. A drying cylinder according to claim 1, wherein the pressurized air is controlled to a pressure level which produces a pressurized air cushion between said cylinder jacket and the fibrous material web.

13. A drying cylinder according to claim 12, wherein the pressurized air cushion has a maximum thickness of about 2 mm.

14. A drying cylinder according to claim 13, wherein the pressurized air cushion has a thickness between about 0.5 mm and 1 mm.

15. A drying cylinder according to claim 1, wherein said cylinder jacket is metal.

16. A drying cylinder according to claim 4, wherein said perforations are bores.

17. A drying cylinder according to claim 1, wherein said air-permeable region is substantially the same width as the fibrous material web.

18. A drying cylinder according to claim 1, wherein said inner chamber includes a fixed cover positioned proximate a portion of said cylindrical jacket, which is not in contact with the fibrous material web, wherein said fixed cover is adapted to prevent pressurized air from escaping from said portion of the jacket which is not in contact with the fibrous material web.

19. A drying section for drying a fibrous web, comprising:

at least one drying cylinder having an inner chamber and an outer cylinder jacket having an air-permeable region;

a circulating belt arranged to press the fibrous web against said outer cylinder jacket and belt being arranged to partially wrap around said at least one drying cylinder;

a pressurized air source connected to said inner chamber;

a cover located within the outer cylinder jacket to selectively define the air permeable region; and a radiant heating device positioned adjacent the cover to heat the outer jacket cylinder.

20. A drying section according to claim 19, wherein said pressurized air source is adapted to form an air cushion between said outer cylinder jacket and the fibrous web.

21. A drying section according to claim 19, said radiant heating device comprising at least one of infrared radiators, gas burners, and induction heaters for heating said drying cylinder.

22. A drying section according to claim 19, wherein said cylinder jacket has an air-permeable region which is in contact with the fibrous material web.

23. A drying section according to claim 22, wherein said cylinder jacket has perforations in said air permeable region.

24. A drying section according to claim 19, wherein said cylinder jacket is covered by an air-permeable cylinder belt, said belt having a smooth surface in the region of contact with the fibrous material web.

25. A drying section according to claim 24, wherein said cylinder belt is a woven belt.

26. A drying section according to claim 19, wherein said circulating belt is a drying wire belt.

27. A drying section to according to claim 19, wherein said pressurized air source is heated in said drying cylinder.

28. A drying section according to claim 27, said radiant heating device positioned to heat said cylinder jacket to a temperature of over about 200° C.

29. A drying section according to claim 28, wherein said cylinder jacket is heated to a temperature in a range of about 200° to 400° C.

30. A drying section according to claim 19, wherein said pressurized air source is controlled to a pressure level which produces a pressurized air cushion between said cylinder jacket and said fibrous material web.

31. A drying section according to claim 30, wherein said pressurized air cushion has a maximum thickness of about 2 mm.

32. A drying section according to claim 31, wherein said pressurized air cushion has a thickness between about 0.5 mm and 1 mm.

33. A drying section according to claim 19, wherein said cylinder jacket is metal.

34. A drying section according to claim 23, wherein said perforations are bores.

35. A drying section according to claim 22, wherein said air-permeable region is substantially the same width as the fibrous material web.

36. A drying section according to claim 19, wherein said cover includes a fixed cover positioned proximate a portion of said cylindrical jacket, which is not in contact with the fibrous material web, wherein said fixed cover is adapted to prevent pressurized air from escaping from said portion of the jacket which is not in contact with the fibrous material web.

37. A drying cylinder for drying a fibrous web, said cylinder comprising:

an inner chamber connected to a pressurized air source;

an outer cylinder jacket having an air-permeable region;

a metal drying wire being guided over said air permeable region in contact with said outer cylinder jacket; and a radiant heating device positioned adjacent said outer cylinder jacket in a region remote from said air permeable region.

* * * * *